US006612116B2

(12) United States Patent
Fu et al.

(10) Patent No.: US 6,612,116 B2
(45) Date of Patent: Sep. 2, 2003

(54) THERMOELECTRIC TEMPERATURE CONTROLLED REFRIGERATOR FOOD STORAGE COMPARTMENT

(75) Inventors: Xiaoyong Fu, Cedar Rapids, IA (US); Sheldon Wayne Mandel, East Galesburg, IL (US); Robert Stephen Mercille, O'Fallon, IL (US); Alvin V. Miller, Swisher, IA (US); William J. Vestal, Monmouth, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/270,100

(22) Filed: Oct. 15, 2002

(65) Prior Publication Data

US 2003/0115892 A1 Jun. 26, 2003

Related U.S. Application Data

(63) Continuation-in-part of application No. 10/062,675, filed on Feb. 5, 2002, now Pat. No. 6,463,752, which is a continuation-in-part of application No. 09/487,714, filed on Jan. 19, 2000, now Pat. No. 6,343,477, which is a continuation-in-part of application No. 09/258,355, filed on Feb. 26, 1999, now Pat. No. 6,170,276.

(51) Int. Cl.[7] ..... F25B 21/02

(52) U.S. Cl. ..... 62/3.6; 62/186; 62/407; 62/440

(58) Field of Search ..... 62/3.6, 332, 186, 62/182, 407, 408, 414, 419, 440, 441, 187

(56) References Cited

U.S. PATENT DOCUMENTS

| | | | |
|---|---|---|---|
| 1,693,387 | A | 11/1928 | Juneau et al. |
| 1,774,312 | A | 8/1930 | Braeutigam |
| 2,246,342 | A | 6/1941 | Brown |
| 2,404,851 | A | 7/1946 | Knowles et al. |

(List continued on next page.)

FOREIGN PATENT DOCUMENTS

| | | |
|---|---|---|
| EP | 298347 | 1/1989 |
| EP | 535519 | 4/1993 |
| EP | 719994 | 7/1996 |
| JP | 4-143569 | 5/1992 |
| JP | 4-302976 | 10/1992 |
| JP | 2000-320942 | 11/2000 |

*Primary Examiner*—William C. Doerrler
*Assistant Examiner*—Mohammad M. Ali
(74) *Attorney, Agent, or Firm*—Diederiks & Whitelaw, PLC

(57) ABSTRACT

A food storage system mounted in a fresh food compartment of a refrigerator includes an enclosure, as well as a food receptacle slidably positioned in the enclosure. A thermoelectric (TE) device is employed to establish a flow of temperature controlled air for establishing a desired temperature in the food receptacle. In accordance with one embodiment, the thermoelectric device is positioned in a chamber defined behind the food receptacle. In another embodiment, the thermoelectric device comprises a module located atop the enclosure.

17 Claims, 9 Drawing Sheets

U.S. PATENT DOCUMENTS 2,561,276 A 7/1951 Hill
2,837,899 A 6/1958 Lindenblad
3,307,365 A * 3/1967 Townsend ..... 62/3.6
3,364,694 A 1/1968 Cohen et al.
3,473,345 A 10/1969 Pfeiffer et al.
3,600,905 A 8/1971 Dymek et al.
3,638,717 A 2/1972 Harbour et al.
3,680,941 A 8/1972 Shanks
3,733,836 A 5/1973 Corini
3,759,053 A 9/1973 Swaneck, Jr.
3,821,881 A * 7/1974 Harkias ..... 62/3.6
3,834,180 A 9/1974 French, III et al.
4,014,178 A * 3/1977 Kells ..... 62/3.6
4,148,194 A * 4/1979 Kells ..... 62/3.6
4,173,378 A 11/1979 Hanson et al.
4,358,932 A 11/1982 Helfrich, Jr.
4,364,234 A 12/1982 Reed
4,627,242 A * 12/1986 Beitner ..... 62/3.6
4,639,883 A 1/1987 Michaelis
4,646,528 A 3/1987 Marcade et al.
4,662,186 A 5/1987 Park
4,663,941 A 5/1987 Janke
4,689,966 A 9/1987 Nonaka
4,722,200 A 2/1988 Frohbieter
4,732,009 A 3/1988 Frohbieter
4,732,014 A 3/1988 Frohbieter
4,751,826 A 6/1988 Kawahara et al.
4,788,832 A 12/1988 Aoki et al.
4,858,443 A 8/1989 Denpou
4,879,881 A 11/1989 Madigan
4,891,949 A 1/1990 Caldarola
4,920,758 A 5/1990 Janke et al.
4,924,680 A 5/1990 Janke et al.
5,095,717 A 3/1992 Germi
5,212,962 A 5/1993 Kang et al.
5,277,039 A 1/1994 Haasis
5,301,508 A 4/1994 Kahl et al.
5,315,830 A 5/1994 Doke et al.
5,319,937 A 6/1994 Fritsch et al.
5,392,615 A 2/1995 Lim
5,444,984 A * 8/1995 Carson ..... 62/3.4
5,501,076 A 3/1996 Sharp, III et al.
5,522,216 A 6/1996 Park et al.
5,551,252 A 9/1996 Lee
5,572,873 A 11/1996 Lavigne et al.
5,605,047 A 2/1997 Park et al.
5,661,978 A 9/1997 Holmes et al.
5,678,413 A 10/1997 Jeong et al.
5,725,294 A * 3/1998 Froelicher ..... 312/401
5,778,688 A 7/1998 Park et al.
5,782,106 A * 7/1998 Park ..... 62/452
5,799,496 A 9/1998 Park et al.
5,845,497 A 12/1998 Watanabe et al.
5,881,560 A 3/1999 Bielinski
5,896,748 A 4/1999 Park
5,918,480 A 7/1999 Nagata et al.
5,927,078 A 7/1999 Watanabe et al.
5,934,085 A * 8/1999 Suzuki et al. ..... 62/98
5,946,919 A * 9/1999 McKinney et al. ..... 62/3.7
5,979,174 A 11/1999 Kim et al.
5,983,654 A 11/1999 Yamamoto et al.
6,006,531 A 12/1999 Pritts et al.
6,038,865 A 3/2000 Watanabe et al.
6,055,826 A 5/2000 Hiraoka et al.
6,089,237 A 7/2000 Podolak, Jr. et al.
6,101,819 A 8/2000 Onaka et al.
6,122,918 A 9/2000 Johnson, Jr.
6,170,276 B1 1/2001 Mandel et al.
6,215,660 B1 4/2001 Lin
6,223,553 B1 5/2001 Albert et al.
6,343,477 B1 2/2002 Mandel et al.

* cited by examiner

FIG. 10
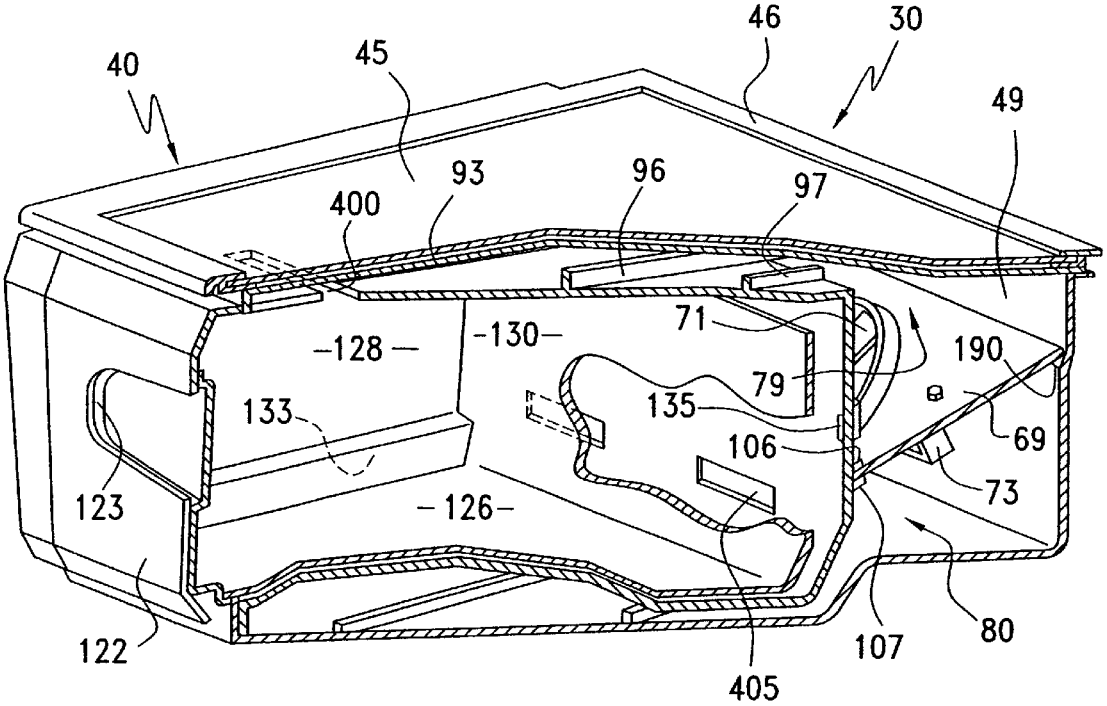
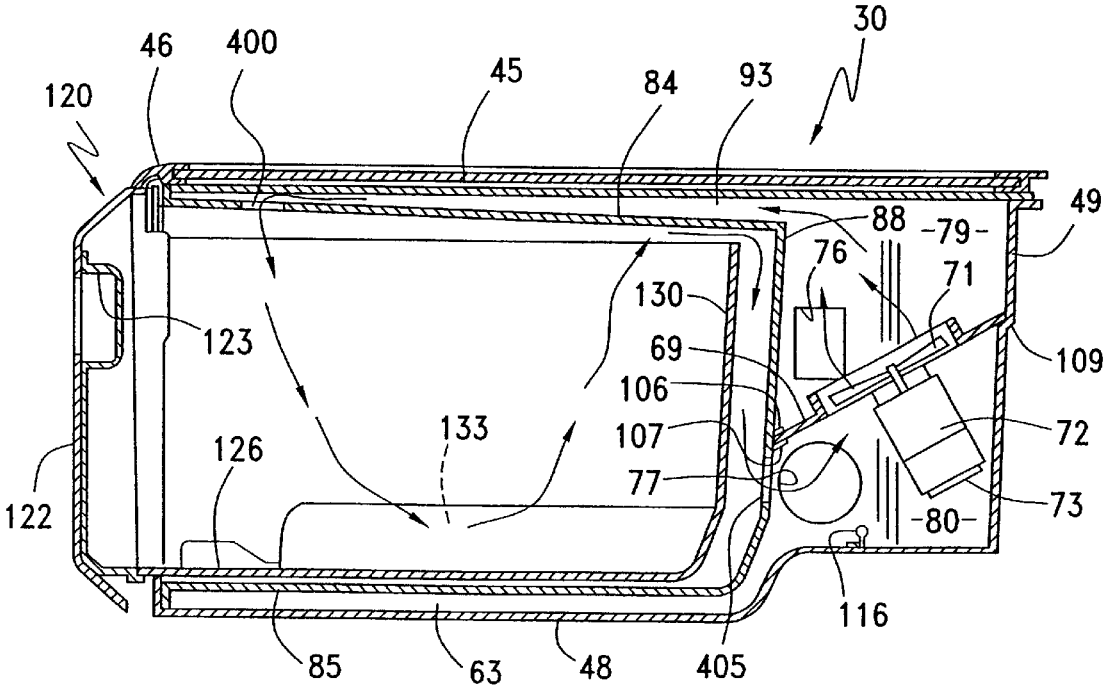
FIG. 11

THERMOELECTRIC TEMPERATURE CONTROLLED REFRIGERATOR FOOD STORAGE COMPARTMENT

CROSS-REFERENCE TO RELATED APPLICATIONS

This application represents a continuation-in-part of U.S. patent application Ser. No. 10/062,675 filed Feb. 5, 2002 now U.S. Pat. No. 6,463,752, which is a continuation-in-part of U.S. patent application Ser. No. 09/487,714 filed Jan. 19, 2000, now U.S. Pat. No. 6,343,477, which is a continuation-in-part of U.S. patent application Ser. No. 09/258,355 filed Feb. 26, 1999, now U.S. Pat. No. 6,170,276.

BACKGROUND OF THE INVENTION

1. Field of the Invention

The present invention pertains to the art of refrigerators and, more particularly, to a specialty storage compartment incorporating a quick chill feature provided within a fresh food compartment of a refrigerator.

2. Discussion of the Prior Art

In the art of refrigerators, particularly household refrigerators, it is often desirable to create varying humidity and/or temperature storage zones to enhance the preservation of different food items. For instance, it is common to accommodate the storage requirements for certain food items, such as dairy products, meats, fruits and vegetables, by forming separately enclosed storage areas within a fresh food compartment. In most instances, these storage areas are designed to be maintained at temperatures which are different from the temperature of the remainder of the fresh food compartment.

In at least the case of fruits and vegetables, it is typically desirable to isolate these food items from direct contact with a flow of cooling air, especially any cold air flowing into the fresh food compartment from a freezer compartment of the refrigerator, mainly because this cold air can be fairly dry. Therefore, in order to isolate the fruits and vegetables from the desiccating effects of the cold air so as to maintain the moisture content of the fruits and vegetables, it has heretofore been proposed to provide a specialized storage receptacle, such as a crisper, within a refrigerator fresh food compartment. A crisper generally takes the form of a slidable bin which is sealed to maintain a relatively high humidity level, while the walls of the bin are chilled to establish a desirable temperature within the bin.

Many different food storage compartment designs have been proposed in the art in an attempt to establish and maintain effective humidity and temperature conditions within the compartment while attempting to avoid the development of condensation. However, there still exists a need for an improved control system for maintaining a desired humidity level, accurately regulating the temperature and minimizing the tendency for condensation within a specialty storage compartment provided in the fresh food compartment of a refrigerator.

SUMMARY OF THE INVENTION

The present invention is directed to a high performance refrigerator storage compartment system which is constructed to prevent the loss of humidity, provide an accurately controlled temperature environment and minimize the potential for condensation within a food storage receptacle. In accordance with the invention, the system includes an enclosure, which is mounted within a fresh food compartment of a refrigerator, and a food receptacle, preferably in the form of a bin or drawer, which is slidably mounted between a retracted position, wherein a food storage body portion of the receptacle is generally sealed within the enclosure, and an extended position, wherein the food receptacle is at least partially withdrawn from the enclosure to access the storage body.

In the most preferred form of the invention, a flow of cool air is developed through the use of a thermoelectric (TE) device and directed into the food receptacle. More specifically, the TE device employs hot and cold side heat sinks, hot and cold side fans, a TE module, a conductive block and a layer of insulation, to develop a flow of temperature controlled air which flows through the food receptacle to establish a uniform, accurate temperature for the food storage receptacle. At least one temperature sensor is preferably provided to sense the temperature in the enclosure for use in controlling the flow of cool air, in combination with controls provided at the front of the bin.

Additional objects, features and advantages of the invention will become readily apparent from the following detailed description of preferred embodiments of the invention when taken in conjunction with the drawings wherein like reference numerals refer to corresponding parts in the several views.

BRIEF DESCRIPTION OF THE DRAWINGS

FIG. 10 is a perspective view of the system, shown partially cut-away in a manner similar to that of FIG. 4, but depicting an additional air flow configuration;

FIG. 11 is a cross-sectional side view of the system of FIG. 10;

DETAILED DESCRIPTION OF THE PREFERRED EMBODIMENTS

Figure 1:
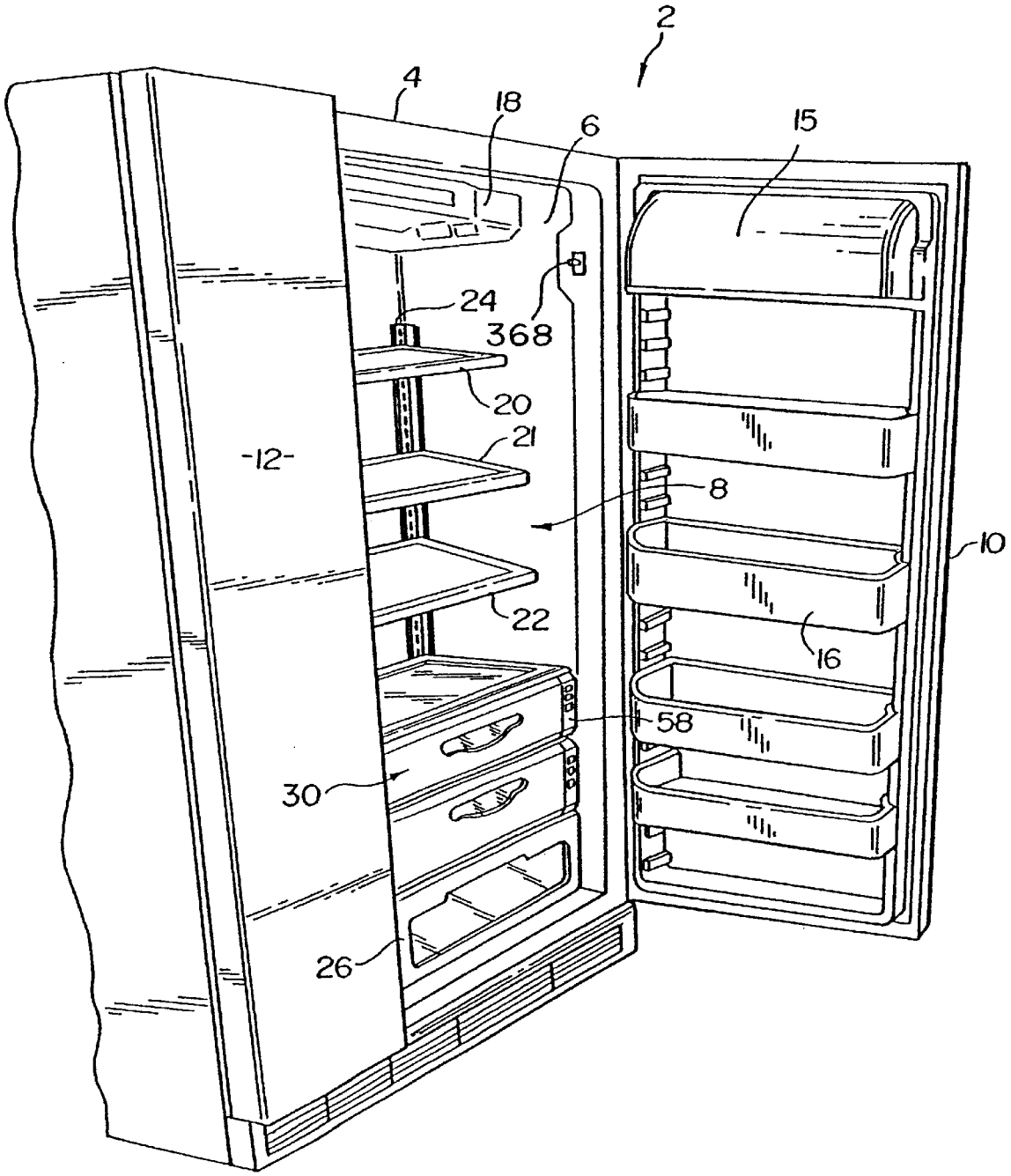
FIG. 1 is a partial, front perspective view of a side-by-side refrigerator incorporating the high performance food storage system of the present invention in the fresh food compartment thereof.
Figure 2:
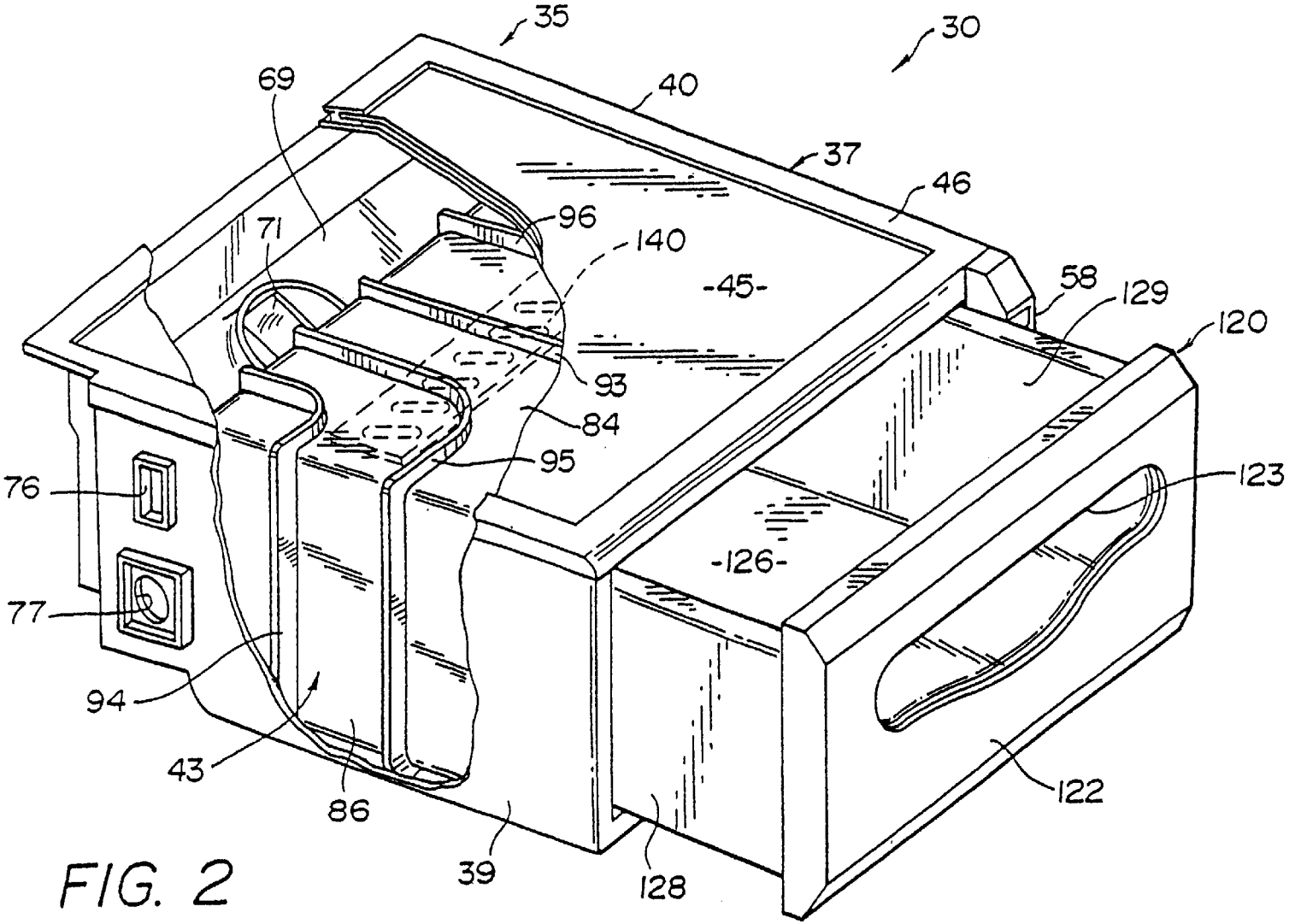
FIG. 2 is an enlarged, partial cut-away view of the system illustrated in FIG. 1.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, refrigerator cabinet 2 is shown to include, on door 10, a dairy compartment 15 and various vertically adjustable shelving units, one of which is indicated at 16. Mounted in an upper area of fresh food compartment 8 is a temperature control housing 18 which, in a manner known in the art, can be used to regulate the temperature in both fresh food compartment 8 and the freezer compartment. Further illustrated, for exemplary purposes, is a plurality of shelves 20–22 which are cantilevered from spaced rails, one of which is indicated at 24. At a lowermost portion of fresh food compartment 8 is illustrated a slidable bin 26. As indicated above, the above described structure is known in the art and presented only for the sake of completeness. The present invention is particularly directed to a food storage compartment system which is generally indicated at 30. Although FIG. 1 actually illustrates two such compartment systems 30, it should be realized that the actual number of compartment systems 30 can be readily varied.

Reference will now be made to FIGS. 2–5 in describing a first preferred embodiment of the system 30 of the present invention. As illustrated, system 30 includes an enclosure 35 having an outer housing 37, formed from a lower section 39 and an upper section 40, and an inner housing 43. Given that the embodiment shown in FIGS. 2–5 corresponds to the upper system 30 shown in FIG. 1, upper section 40 of enclosure 35 is preferably defined by a glass plate 45 that is encapsulated in a plastic rim 46 such that the upper section 40 of the enclosure 35 has an upper exposed surface generally similar to each of cantilevered shelves 20–22. It should also be realized, however, that upper section 40 could simply be constituted by a unitary plate, such as one formed of plastic.

In the most preferred form, lower section 39 of outer housing 37 includes a bottom wall 48, an upstanding rear wall 49, upstanding side walls 51 and 52 and an open frontal portion indicated at 54. In the preferred embodiment, the entire lower section 39 of outer housing 37 is integrally molded of plastic, with a wall 56 projecting laterally from side wall 52 as perhaps best shown in FIG. 3. Wall 56 establishes a mounting section 57 within which a control module 58 (see FIG. 1) is arranged.

Referring back to FIGS. 2–5, the bottom wall 48 of lower section 39 of outer housing 37 has a first, frontal section 60 which leads to a raised second, rear section 61. Bottom wall 48 is preferably formed with a plurality of vanes, including a central vane 63 and various spaced, curved vanes 64–67. Rear section 61 of outer housing 37 also has associated therewith a partition plate 69 having a central aperture through which projects an impeller portion of a fan 71. Fan 71 includes an electric motor 72 which is secured to partition plate 69 by means of a bracket 73. The actual positioning and mounting of partition plate 69 will be discussed more fully below. However, at this point, it should be realized that partition plate 69 is adapted to be mounted within rear section 61 between spaced openings 76 and 77. In this embodiment, opening 76 constitutes an air inlet and opening 77 defines an air outlet such that the zone above partition plate 69 defines an upper plenum chamber 79 and the zone below partition plate 69 defines a lower plenum chamber 80. Again, this structure will be more fully brought out when describing the remaining structure associated with storage compartment system 30.

As indicated above, system 30 also includes an inner housing 43 that is preferably molded of plastic to include a top wall 84, a bottom wall 85, side walls 86 and 87, a rear wall 88 and an open frontal portion 89. In the preferred form of the invention, open frontal portion 89 is formed with an annular, outwardly extending flange 90. As clearly shown in these figures, top wall 84 of inner housing 43 is formed with a central vane 93, as well as various spaced and curved vanes 94–97, each of which extends from adjacent rear wall 88 a predetermined distance towards annular flange 90 in a manner essentially parallel to central vane 93. Thereafter, each vane 94–97 includes an arcuate section which leads the vane towards a respective side wall 86, 87. Each of the vanes 94–97 then extends downwardly along a respective side wall 86, 87. Furthermore, in the most preferred form of the invention, rear wall 88 includes lateral extensions 99 and 100 which also define vanes at a rear edge portion of side walls 86 and 87 respectively.

Inner housing 43 is adapted to be positioned within outer housing 37 in a manner which aligns the lower terminal ends of vanes 94–97 at side walls 86 and 87 with curved side vanes 64–67. With the alignment of these vanes, enclosure 35 defines various channels or passages between respective sets of the vanes. For example, vanes 93 and 96 establish an air flow passage 101, in conjunction with upper section 40, which extends from upper plenum chamber 79 toward annular flange 90, then downward along side wall 87, between bottom wall 85 of inner housing 43 and bottom wall 48 of outer housing 37. Between these bottom walls, passage 101 continues due to the arrangement of central vane 63 and curved vane 66 into lower plenum chamber 80. Given the arrangement of the numerous vanes and the formation of the various passages, a flow of air-developed by fan 71 will be assured to extend across essentially the entire outer surface area of inner housing 43.

At this point, it is important to note that outer housing 37 has a greater depth than inner housing 43. This is perhaps best illustrated in FIGS. 4 and 5. It is based on this difference in depth that partition plate 69 can be arranged to define the upper and lower plenum chambers 79 and 80. More specifically, in the preferred embodiment, rear wall 88 of inner housing 43 is preferably formed with a pair of horizontally extending projections 106 and 107 and rear wall 49 of outer housing 37 is integrally formed with a ledge 109. Partition plate 69 has one lateral edge arranged between projections 106 and 107 and a second, laterally extending edge which is seated upon ledge 109 such that fan 71 is advantageously angled upwardly and forwardly.

With this arrangement, air within enclosure 35 will be forced to flow upwardly out of upper plenum chamber 79 across substantially the entire top wall 84 of inner housing 43, down between side walls 86, 87 and side walls 51 and 52, within the passages defined between bottom wall 48 and bottom wall 85 and to return into lower plenum chamber 80. In accordance with the preferred embodiment of the invention, a majority of the air returning to lower plenum chamber 80 is recirculated. However, inlet 76 is placed in fluid communication with air flowing within the freezer compartment of refrigerator cabinet 2 through the vertical dividing wall or mullion (not shown) which conventionally separates the refrigerator compartments. Supplying cold air from a freezer compartment to a specialty compartment zone is fairly conventional in the art. In accordance with the preferred embodiment, a damper (not shown) is preferably provided to control the amount of cold air flowing into inlet 76, with the damper being regulated through the manual setting of control module 58. Although further details of the damper arrangement will be provided below, at this point it should be noted that a first temperature sensor 116 is shown provided within lower plenum chamber 80 (see FIG. 5) and a second temperature sensor 117 (see FIG. 6) extends within inner housing 43 through an opening 118. Temperature sensor 116 is connected to control module 58 for use in regulating the damper that controls the amount of intake air permitted to flow through inlet 76, while temperature sensor 117 is used to sense an actual temperature in inner housing 43. Although two temperature sensors 116 and 117 have been shown, the most preferred embodiment only utilizes temperature sensor 117 which can function to also control the damper as will be detailed fully below.

Figure 3:
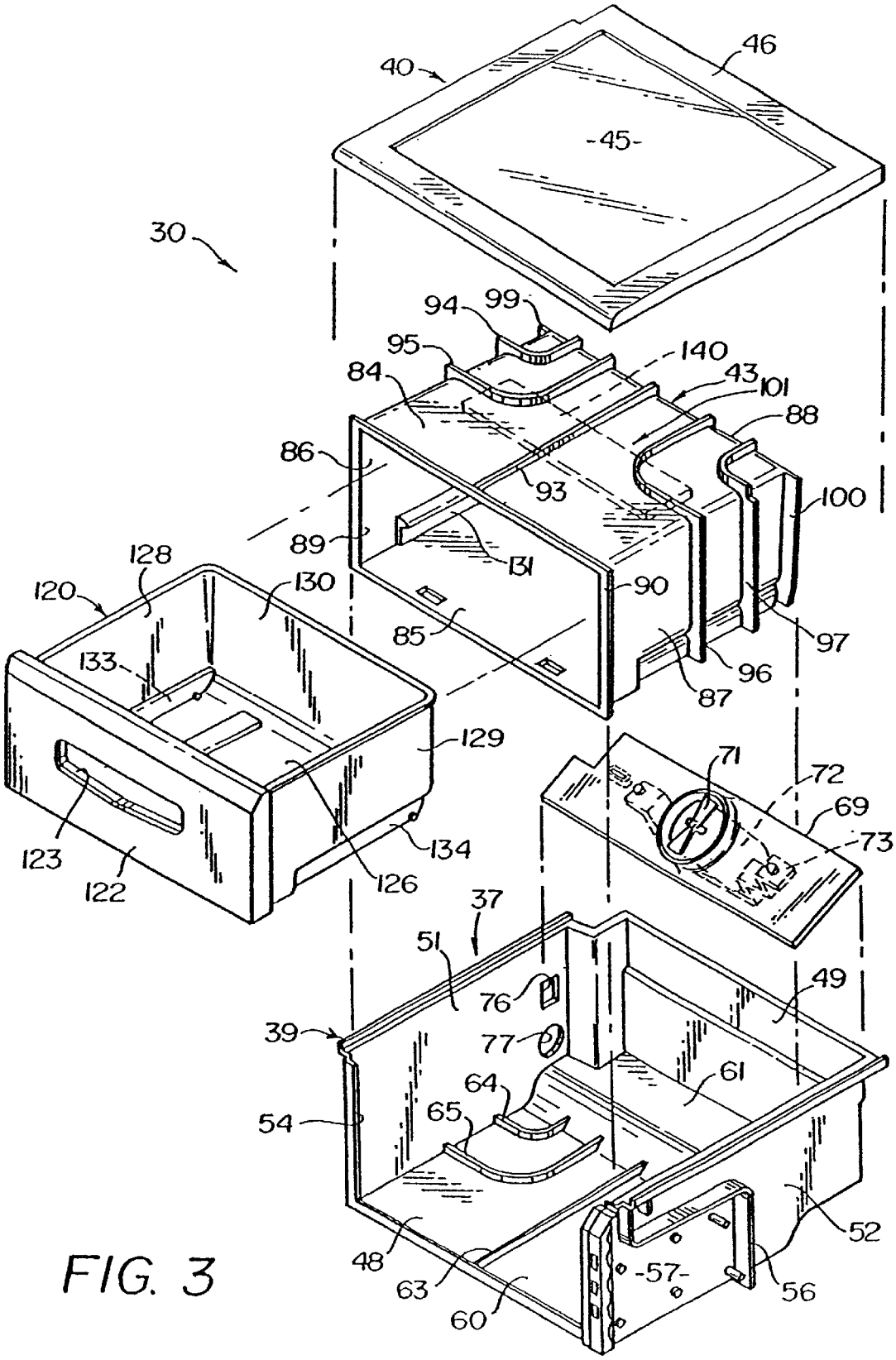
FIG. 3 is an exploded view of the system constructed in accordance with a first embodiment of the invention.
Figure 4:
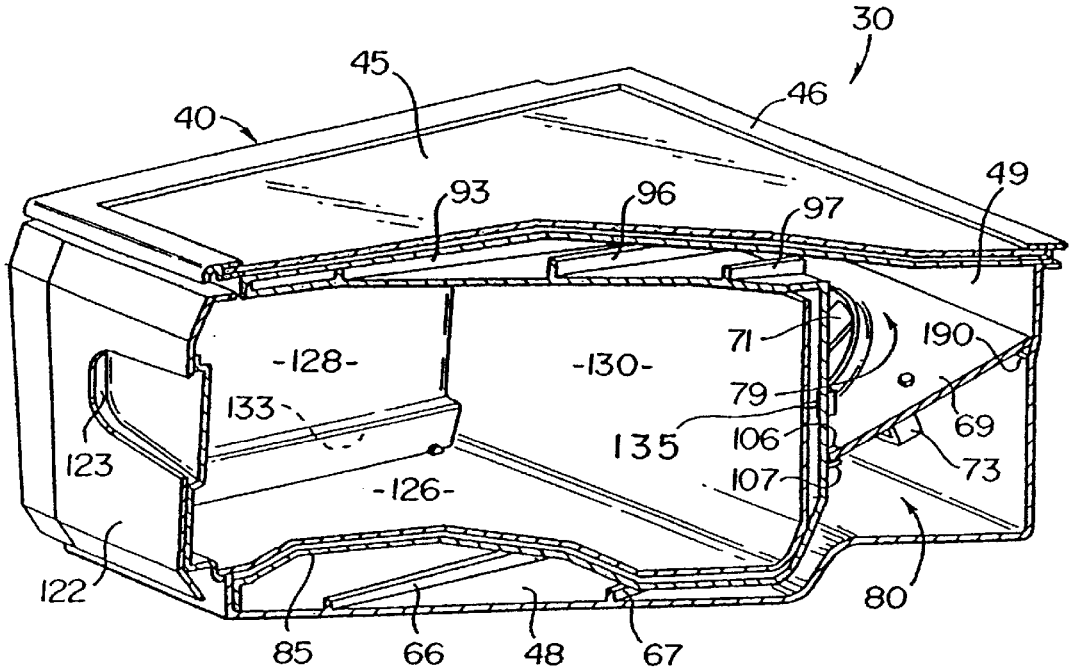
FIG. 4 is a perspective view of the system of FIG. 3 with a cut-away portion.
Figure 5:
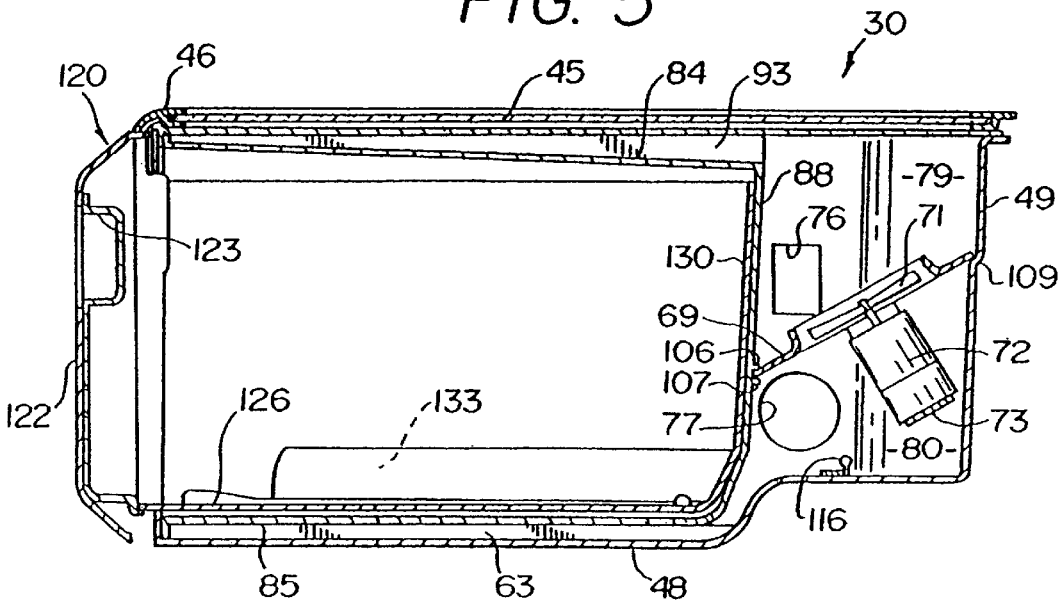
FIG. 5 is a cross-sectional side view of the system of FIGS. 3 and 4.

System 30 also includes a receptacle 120 that takes the form of a drawer or bin having a front wall 122 provided with a handle 123, a floor 126, side walls 128 and 129 and a rear wall 130. In the preferred embodiment shown, floor 126, side walls 128 and 129 and rear wall 130 are integrally molded of plastic and a plastic front wall 122 is secured thereto, such as through sonic welding. Receptacle 120 is adapted to be slidably mounted within inner housing 43 between a retracted position, as best shown in FIGS. 4 and 5, and an extended position wherein a storage area defined by receptacle 120 can be accessed for the placement and removal of food items, such as fruits and vegetables. For slidably supporting receptacle 120, inner housing 43 is preferably provided with a pair of horizontally extending rails, one of which is shown in FIG. 3 at 131, which extend within elongated recesses 133 and 134 defined at the lowermost section of side walls 128 and 129. Of course, other types of guiding support arrangements could be readily provided without departing from the spirit of the invention. Furthermore, to signal the closure of receptacle 120, a switch 135 is adapted to be engaged as shown in FIG. 4.

When fully closed, the front wall 122 of receptacle 120 tightly abuts enclosure 35 such that system 30 essentially provides a tightly sealed receptacle 120 so as to prevent the undesirable loss of humidity. Since a cooling air flow extends essentially around the entire outer surface of inner housing 43, each of the side walls 128 and 129 and rear wall 130 of receptacle 120 are indirectly cooled, as well as the interior of the receptacle 120. This uniform cooling arrangement, in combination with the inclusion and operation of fan 71 and the controlled introduction and exhaust of air into and out of enclosure 35, enables an accurate temperature control environment to be established for the system 30, while minimizing any tendency for condensation within receptacle 120. Again, the preferable flow of air developed by fan 71 is upward from behind receptacle 120, passes over the top of the receptacle 120 and, through the use of vanes 63–67 and 93–97, is channeled adjacent to the sides and then across the bottom until it returns to lower plenum chamber 80. Therefore, the flow path causes the air to effectively contact all of the containment surfaces of receptacle 120 in order to provide a good transfer of heat.

Although the preferred embodiment incorporates temperature sensor 117 to regulate the amount of cold air drawn into upper plenum chamber 79 from the freezer compartment as established by the manually set controls, it should be noted that cold air from the freezer compartment could be drawn into the enclosure by virtue of the relative static pressure between the freezer compartment and the low pressure plenum chamber 80 of enclosure 35. As indicated above, this flow could also be controlled by an electromechanical damper regulated by the electronic control module 58. In any event, as cold air is injected from the freezer compartment into inlet 76, a corresponding amount of air is ejected from enclosure 35 through outlet 77. Typically, the ratio of circulated air to injected air would be quite high in order to ensure minimal temperature gradient throughout the circulated air stream, with the purpose being to cool the contents of the receptacle 120 with a minimum overall temperature difference between the air in the receptacle 120 and the cooling air stream flowing between the inner and outer housings 43 and 37.

In accordance with another aspect of the invention, system 30 preferably incorporates a variable moisture permeable film, such as a currently available shape memory polymer. The potential incorporation of this film is illustrated at 140 by the dotted lines shown in FIG. 2 as incorporated in top wall 84 of inner housing 43. The function of such a variable moisture permeable film is to maintain the optimum humidity, minimize condensation and further enhance the ability of storage compartment system 30 to establish an optimum temperature so as to improve the shelf life of produce or the like stored in receptacle 120. More specifically, shape memory polymers are known to perform humidity control functions as the material inherently increases in moisture permeability with increasing temperature. Therefore, when the temperature remains low in receptacle 120, water vapor is kept from escaping. However, when the temperature increases, the excess water vapor can escape. This reduces the possibility of dew condensation in receptacle 120. Such a shape memory polymer, as currently available in the marketplace, has a glass transition temperature around which its moisture permeability rapidly changes. The moisture permeability range, glass transition temperature, location and an amount of surface area exposed directly to the food items placed within receptacle 120 can be readily optimized to reduce condensation in retaining the optimum humidity level. Although the speed of operation of fan 71 could be regulated through control module 58 to enhance the rate at which the conditioned air flows within enclosure 35 to control the moisture transfer rate through the shape memory polymer material, in the most preferred form of the invention, fan 71 is simply controlled to be either on or off. In any case, when such a known moisture permeable film is included in system 30, fan 71 will aid in regulating the moisture transfer rate through the material to further aid in establishing the optimum humidity in the receptacle 120.

Figure 6:
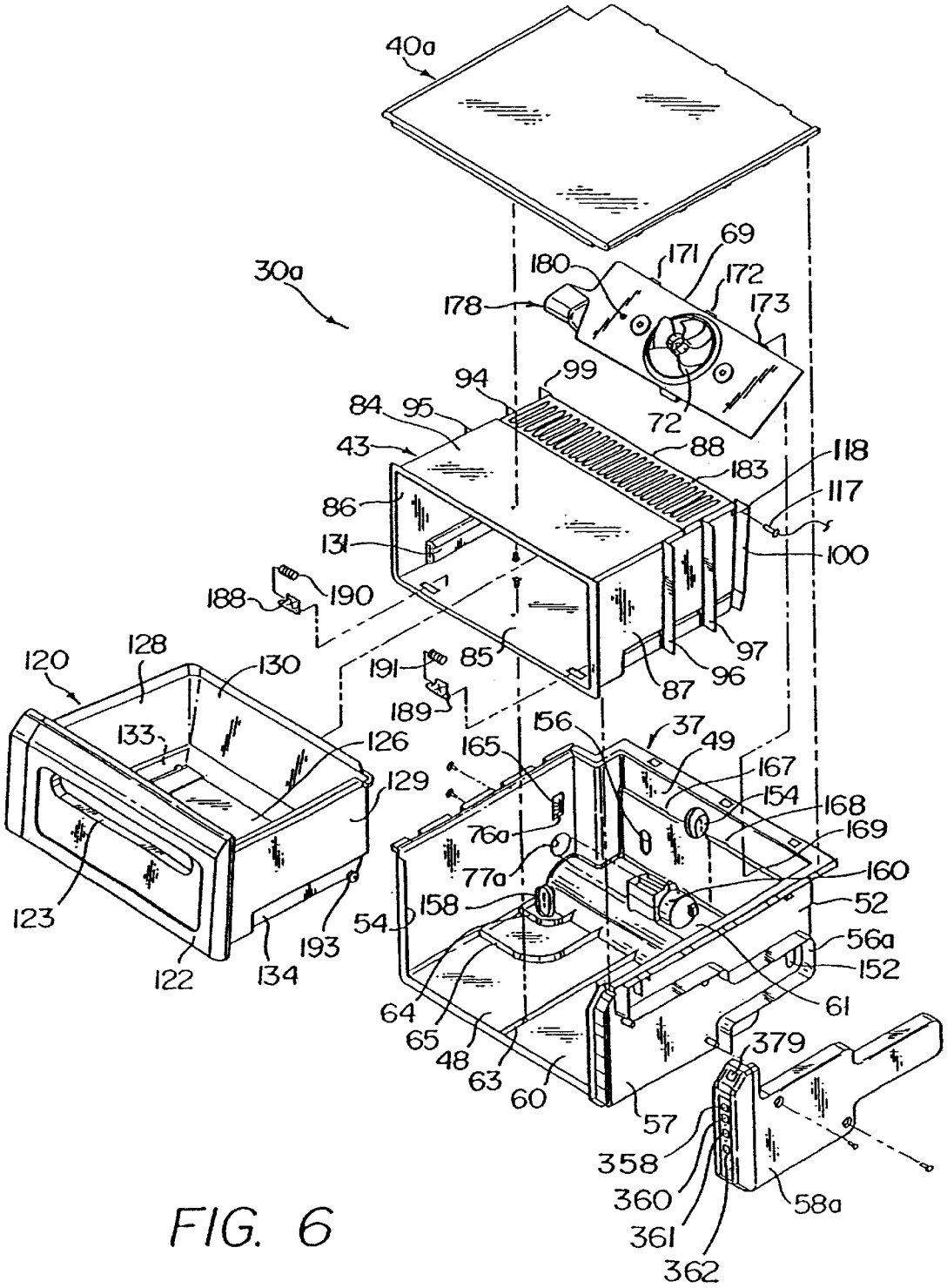
FIG. 6 is an exploded view similar to that of FIG. 3 but depicting a system constructed in accordance with a second embodiment of the invention.

Reference will now be made to FIG. 6 in describing another preferred embodiment for the food storage system of the present invention. In general, the system **30*a* of this embodiment is constructed and operates in a manner corresponding to that described above with respect to the first embodiment of the invention. However, this embodiment brings out further potential design modifications within the scope of the overall invention. Since a majority of the structure of this embodiment directly corresponds to that described above, like reference numerals will refer to corresponding parts in the several views and the differences between the embodiments will be brought out below, with these differences being generally apparent from comparing FIGS. 3 and 6** of the present application.

First of all, in accordance with the embodiment of FIG. 6, it should be noted that outer housing 37 is provided with a slightly differently configured wall **56*a* to accommodate control module 58*a*. At a rear portion of upstanding side wall 52 of outer housing 37, there is shown an opening 152 which is provided for the routing of wires to control module 58*a*. A corresponding type of opening would also be provided in the first embodiment described above but has not been shown to simplify the drawings. In any event, as depicted in FIG. 6, opening 152 receives a plug 154 through which the wires would extend. A similar opening 156 is depicted for upstanding rear wall 49 which also receives a plug 158** that can accommodate the passage of wires therethrough.

One major distinction between the embodiment shown in FIGS. 2–5 and that illustrated in FIG. 6 is that opening 76*a* and this embodiment represents an air outlet for the storage compartment system and opening 77*a* represents the inlet. Mounted at air inlet 77*a* is a damper 160 that is electrically linked to control module 58*a* by suitable wiring (not shown). In accordance with this embodiment, air outlet 76*a* is also provided with a flap valve indicated at 165. Another difference in the construction of outer housing 37 of this embodiment is the inclusion of various laterally spaced slots 167–169 that are provided in upstanding rear wall 49 for the mounting of partition plate 69. Correspondingly, partition plate 69 is provided with various laterally spaced tabs 171–173 such that, unlike the first embodiment where the partition plate 69 rests against ledge 109, the tabs 171–173 are received within respective slots 167–169 for the securing of partition plate 69.

In addition, it will be noted that partition plate 69 of this embodiment is formed with a deflector 178 which is shaped to conform to a portion of damper 160 when the system 30*a* is assembled but which is maintained spaced from rear wall 88 of inner housing 43 a slight distance which enables warmer air to bleed adjacent to air inlet 77*a*. Therefore, deflector 178 allows some mixing of warmer air with the coldest air delivered into outer housing 37 through air inlet 77*a*. Furthermore, partition 69 is provided with an aperture 180 through which is adapted to project a temperature sensor (not shown) which replaces temperature sensor 116 in that it signals control module 58*a* for regulating the opening and closing of damper 160. Again, preferably only temperature sensor 117 is actually provided.

With this arrangement, the amount of inlet air drawn into lower plenum chamber 80 through opening 77*a* is controlled by the opening and closing of damper 160. Fan 72 operates in the manner described above in that it functions to direct air over the top wall 84, along side walls 86 and 87 and along bottom wall 85 of inner housing 43. Depending upon the pressure differential created, flap valve 165 can permit a percentage of the air flow to be exhausted from within the enclosure 35. This embodiment also illustrates that it is possible to remove vanes 94–97 from the top wall 84 of inner housing 43. In this embodiment, the corresponding portions of the vanes are provided beneath upper section 40*a* to perform the identical air directing function. The embodiment of FIG. 6 also illustrates the inclusion of a grill 183 as part of top wall 84. Grill 183 can be integrally formed with inner housing 43 or formed as a separate piece and attached thereto. In either case, grill 183 is adapted to have secured thereto a corresponding, variable moisture permeable film (not shown) by any means known in the art, including sonic welding or through the use of an adhesive. Although not specifically described above with respect to the first embodiment of the invention, a similar grill or opening arrangement will also be associated with film 140.

Finally, this embodiment illustrates additional structural details that are preferably incorporated in the embodiment of FIG. 1 as well, such as the use of snap-in roller supports 188 and 189 that receive rollers 190 and 191, as well as the inclusion of rollers 193 on either side of receptacle 120. In any case, with the above construction of the storage compartment system in accordance with either of the embodiments described, an effective heat transfer with receptacle 120 is assured, given that the temperature of the circulated air is regulated and efficiently channeled substantially entirely about the receptacle. The moisture permeable film can further enhance the ability of the system to maintain a desired humidity and temperature environment. Furthermore, since the storage compartment system is essentially self-contained, it can be pre-assembled and advantageously mounted as a unit within refrigerator cabinet 2.

Figure 7:
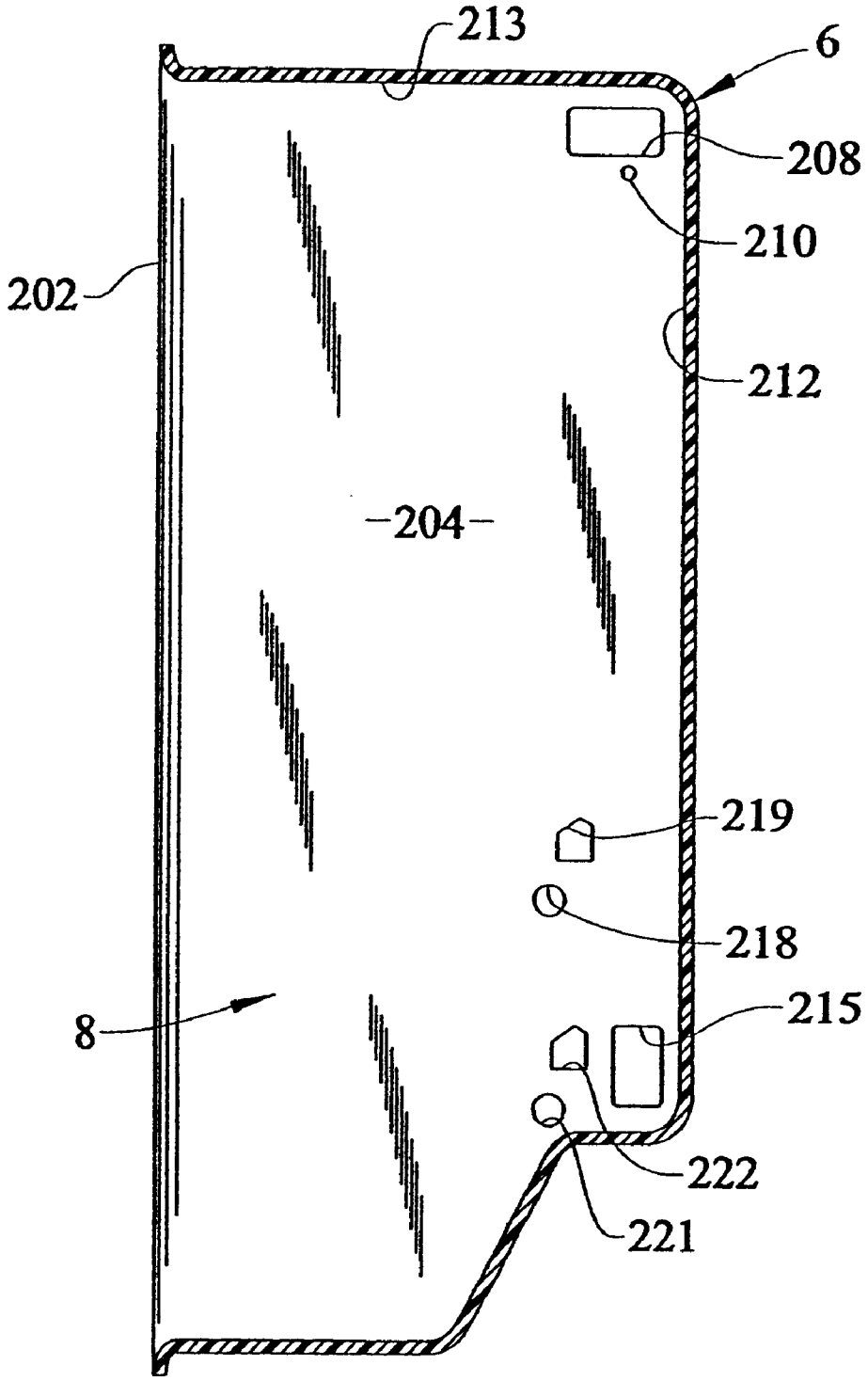
FIG. 7 is a cross-sectional side view of a fresh food compartment liner incorporated in the refrigerator of the present invention.

The present invention is also directed to the overall manner in which cooling air is supplied from the freezer compartment to fresh food compartment 8 and enclosures 35 of the food storage compartment systems 30 and 30*a*, as well as the manner in which return air is exhausted from the fresh food compartment 8 and food storage compartment systems 30 and 30*a*. More specifically, FIG. 7 shows fresh food liner 6 and, particularly, an open frontal portion 202 and a side wall 204 thereof. Formed in side wall 204, at an upper rear portion thereof, is a main air inlet opening 208. In a manner known in the art, air inlet opening 208 is essentially covered by temperature control housing 18 for regulating the air flow into fresh food compartment 8 as discussed more fully below. For the sake of completeness, an aperture 210 is shown below air inlet opening 208. Aperture 210 is adapted to receive a sensor for signaling the temperature of the cooling air entering fresh food compartment 8 as will be detailed more fully below. Again, air inlet opening 208 is shown at an upper rear portion of fresh food liner 6 such that it is substantially directly adjacent a rear wall 212 and a top wall 213. Also formed adjacent rear wall 212, at a lower portion of fresh food liner 6, is a main air return opening 215. At this point, it should be realized that providing air inlet opening 208 and air return opening 215 is substantially conventional in the art in order to enable a flow of cooling air to enter fresh food compartment 8 at air inlet opening 208, to be circulated throughout fresh food compartment 8, and then to exit fresh food compartment 8 through air return opening 215.

Also shown in FIG. 7, side wall 204 of fresh food liner 6 is formed with an upper, preferably circular inlet air opening 218, as well as an upper outlet or exhaust opening 219. Furthermore, a lower air inlet opening 221 and a lower air outlet or exhaust opening 222 are illustrated. In general, each set of openings 218, 219 and 221, 222 are provided for a respective food storage compartment system 30, 30*a*. Since two such vertically arranged systems are provided in accordance with the most preferred embodiment of the invention as illustrated in FIG. 1, side wall 204 of fresh food liner 6 is provided with two sets of inlet and outlet openings 218, 219 and 221, 222. That is, upper inlet opening 218 and upper outlet opening 219 are provided, with reference to the embodiment shown in FIG. 6, to align with openings 77*a* and 76*a* respectively. Lower inlet opening 221 and lower outlet opening 222 are provided for a corresponding purpose for the lower food storage system 30, 30*a*.

The particular routing of air from the freezer compartment to each of the food storage compartment systems 30, 30*a* is actually covered by an application entitled "Air Flow Assembly for Refrigerator Food Storage System" filed on even date herewith, which is incorporated herein by reference. The present invention is particularly directed to an electronic control system for regulating the supply of cooling air for the food storage system 30, 30*a*, as well as the overall fresh food compartment 8.

Figure 8:
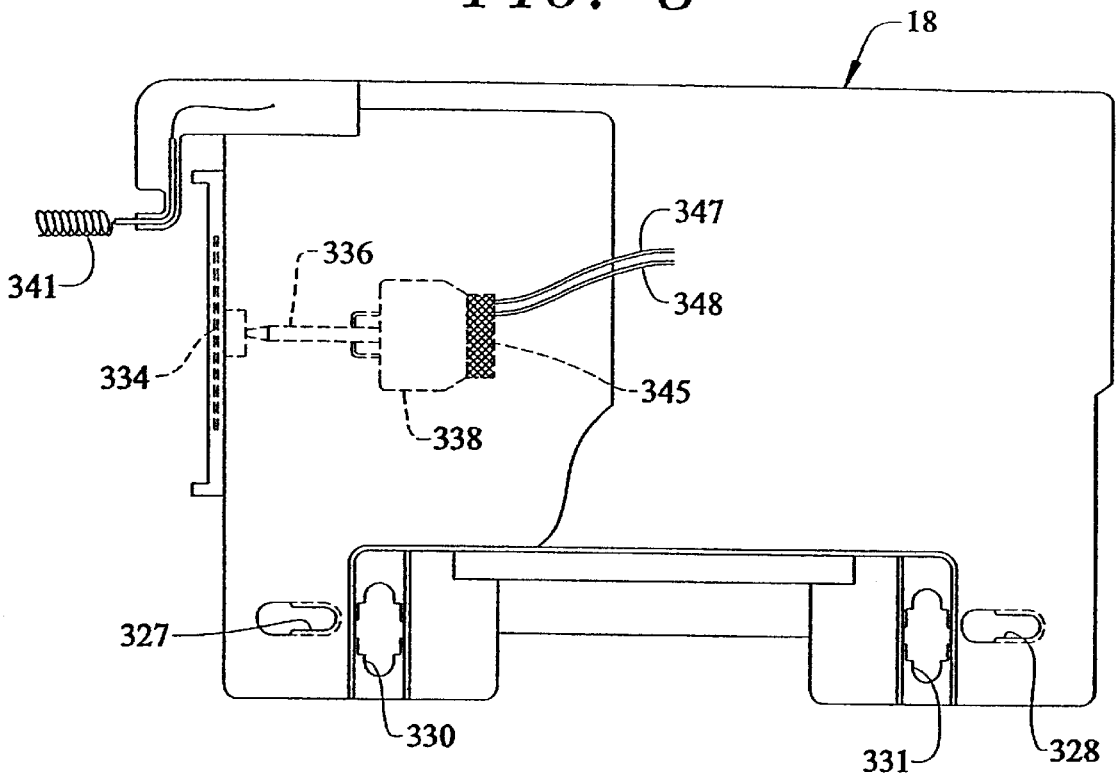
FIG. 8 is generally a top view of the temperature control unit mounted in the refrigerator.

FIG. 8 illustrates some additional details of temperature control housing 18. More particularly, the figure indicates the presence of mounting slots 327 and 328 are used to secure temperature control housing 18 to a top wall of fresh food compartment liner 6. Furthermore, temperature control housing 18 is shown to include a pair of laterally spaced pockets 330 and 331 for receiving mounting structure for respective lights. A damper door is generally indicated at 334. When temperature control housing 18 is mounted within fresh food compartment 8, damper door 334 aligns with main air inlet opening 208 in a manner known in the art. Preferably, damper door 334 is biased to a closed position and can be shifted to variable degrees of opening by means of a linear actuator or piston 336 associated with an auto damper unit 338. Also shown is a temperature sensor 341 which is routed through temperature control housing 18 and also extends through aperture 210 of fresh food liner 6. At this point, it should be noted that the construction of temperature control housing 18 and the construction of damper door 334 and auto damper unit 338 are known in the art, do not form part of the present invention and therefore will not be described further here. Instead, it is the manner in which the control system of the present invention can alter the position of damper door 334 that is of certain concern to the invention. Particularly, in accordance with the present invention, a bias heater 345 is positioned directly adjacent auto damper unit 338 for the reasons which will be more fully discussed below. Bias heater 345 is shown to have a pair of electrical leads 347, 348 extending therefrom.

Figure 9:
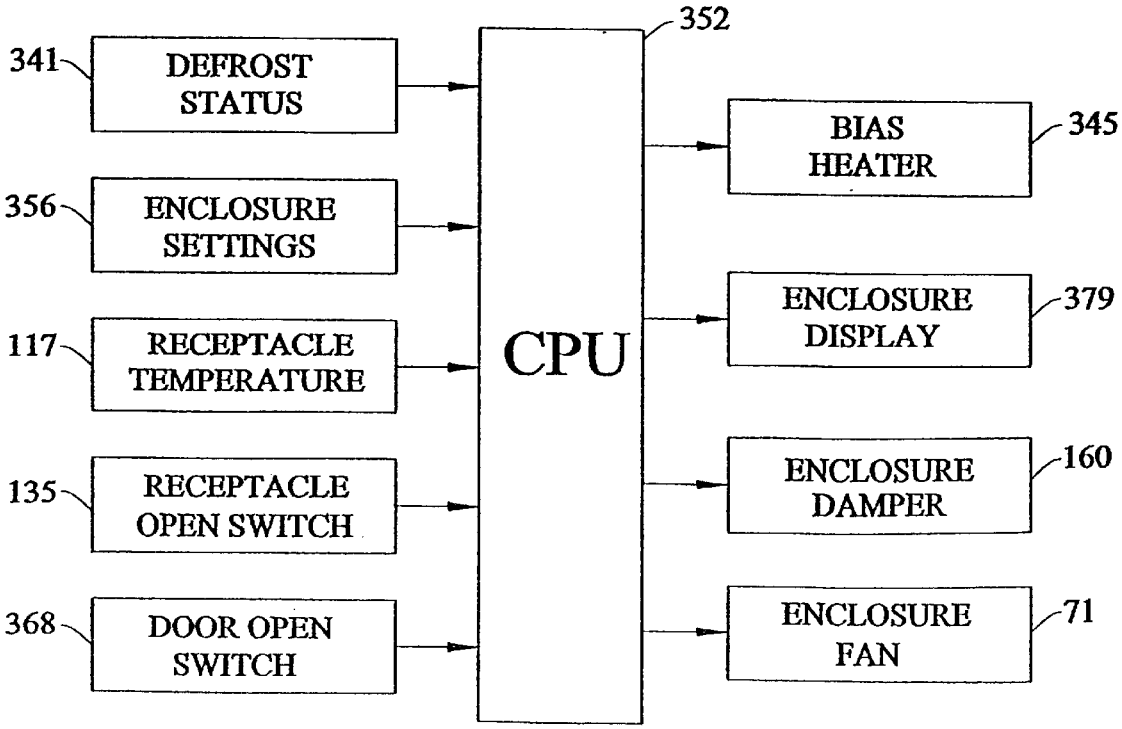
FIG. 9 is a block diagram of a control unit provided in accordance with the invention.

FIG. 9 provides a block diagram which will be used to describe the connections and operations of the air control system of the invention. As shown, a CPU 352 receives signals of a defrost status at 341 and consumer established enclosure settings at 356. More specifically, with reference to the embodiment of FIG. 6, control module 58*a* includes a row of vertical buttons with an upper or first button 358 preferably constituting an on/off button. Below on/off button 358 are arranged various setting buttons such as citrus setting button 360, produce setting button 361 and meat setting button 362. Most preferably, each of buttons 360–362 has associated therewith a small light, such as a green LED, to indicate the established operating settings. Referring back to FIG. 9, CPU 352 also receives signals from temperature sensor 117 in the most preferred embodiment of the invention, and receptacle open switch 135, with this switch being also indicated in FIG. 4 to simply be closed when receptacle 120 is fully retracted. Finally, CPU 352 receives signals from a door open switch at 368, with this door switch being shown clearly in FIG. 1.

In a manner which will be more fully discussed below, CPU 352 processes these signals and outputs control signals to various food storage assembly components such as bias heater 345, an enclosure display indicated in FIG. 9 and also in FIG. 6 with reference numeral 379, damper 160 and the enclosure fan 71 for each food storage system 30, 30*a*.

In regulating the air flow, it is first determined whether set point buttons 360–362 have been selected. As indicated above, it is preferable that a green LED be illuminated on the particular button 360–362. With the presence of lights on buttons 360–362, these lights will be turned off by CPU 352 when fresh food compartment door 10 is closed as sensed by switch 358. When one of set-point buttons 360–362 is pushed, this establishes a desired temperature range for the food storage system 30, 30*a*. The set-point will be displayed in enclosure display 379 which, preferably, is constituted by two seven-segment digit displays. In the most preferred embodiment of the invention, the set-point will be displayed for approximately 3 seconds following the depression of a selected button 360–362, then will return to a temperature display mode wherein the temperature within the receptacle 120 is displayed based on signals received from temperature sensor 117. Most preferably, the display is updated every 15 seconds as follows:

$$\text{new value}=(\text{sensed value}-\text{old value})\times 0.1758+\text{old value}.$$

Although a variable damper unit can be utilized, it is preferable that damper 160 is simply an opened/closed air damper. The open position is utilized to provide additional cooling relative to the set-point based on the selected button 360–362. Temperature stratification within enclosure 30, 30*a* is controlled by fan 71 for air mixing and distribution in the manner fully described above. The motor 72 associated with fan 71 preferably operates on 115 VAC at 60 Hz. Except as specified below, fan 71 essentially operates at all times.

Enclosure display 379 is generally capable of registering temperatures from 25° F. to 70° F. Preferably, any temperature signaled by sensor 117 above or below these values will be limited to these upper and lower values. In the most preferred form of the invention, selecting citrus button 360 will establish a set-point of preferably 39° F. within receptacle 120, with damper 160 being controlled to increase air flow at any temperature above 39.5° F. and below 38.5° F. Selecting produce button 361 will establish a set-point of 34° F. with a cut-in temperature of 34.5° F. and a cut-out temperature of 33.5° F. In a similar manner, selecting meat button 362 will establish a set-point of 31° F., with a cut-in temperature of 31.5° F. and a cut-out temperature of 30.5° F. Of course, it should be realized that these set cut-in and cut-out temperatures only represent a preferred embodiment and that these temperatures can vary in accordance with the invention without departing from the spirit thereof. Preferably, all of the electronic assemblies operate with a tolerance of ±0.75° F. within a 28° F.–40° F. controlled temperature band. Less accuracy is actually required for enclosure display 379.

As indicated above, fan 71 generally operates continuously when any set point button 360–362 is selected. Obviously, respective fans are provided for each of the upper and lower food storage systems 30, 30*a* provided in accordance with the preferred embodiment. When refrigerator cabinet 2 is operated in a defrost cycle as signaled at 341, CPU 352 deactivates each fan 71 and closes the respective damper 160 to prevent excessive temperature stratification in the temperature-controlled compartment. Fan 71 and damper 160 are reactivated at the conclusion of the defrost time, i.e., when the compressor for the refrigerator is powered on. At this time, enclosure display 379 is frozen to reflect the current display temperature. This frozen display condition terminates if receptacle 120 is opened, after 60 minutes following freezing of the display, or temporarily if the sensed temperature returns to ±1° F. of the set-point. If the receptacle 120 is opened during a defrost cycle, but before the freezing of the display 379, the display's freeze function will not be enabled until the next defrost cycle.

During a refrigeration off cycle, CPU 352 continues to permit operation of damper 160 and fan 71. However, if temperature sensor 117 indicates a sensed temperature greater than a predetermined temperature such as 62° F., no power will be supplied to fan 71. However, whenever the temperature within receptacle 120 is below a certain value, for instance 60° F., fan 71 would preferably be powered on. Regardless, the damper 160 shall remain open under either operating conditions for fan 71.

CPU 352 can power down the controls for food storage system 30, 30*a* if no use of receptacle 120 is detected during normal refrigeration operation for a certain period of time, such as four weeks. Use of the receptacle 120 is detected by switch 135 which is preferably located at the rear of the inner housing 43 as described above. Therefore, opening receptacle 120 or selecting a new set-point condition through buttons 360–362 resets the timer programmed into CPU 352. In the case of a power outage, the amount of time previously elapsed will be stored in memory and the system will begin counting from that point in accordance with the preferred embodiment.

Immediately after receptacle 120 has been opened, display 379 will flash the sensed temperature from sensor 117. While receptacle 120 is open, display 379 will continue to be updated on the preset intervals, preferably 15 second intervals. In accordance with the most preferred embodiment, the display shall flash on for 0.6 seconds and off for 1.2 seconds. In addition, during opening of receptacle 120, CPU 352 will deactivate fan 71 and set damper 160 to the closed position. If damper 160 is already in the closed position, it will remain in that state until receptacle 120 is fully closed as sensed by switch 135. Subsequent to receptacle 120 being returned to its closed condition, a change in damper 160 shall be determined by the need for additional compartment cooling.

When damper 160 is set to an open condition and fan 71 is operating, a certain amount of cooling for the overall fresh food compartment 8 is provided. However, when the food storage system 30, 30*a* is deactivated through first button 358, it is desired in accordance with the present invention to compensate by providing additional cooling flow through auto damper unit 338. For this reason, bias heater 345 is associated with auto damper unit 338. In the most preferred embodiment, bias heater 345 constitutes a 0.75 watt, 115 VAC heater. If neither of the upper and lower food storage systems 30, 30*a* is operating, i.e. each fan 71 is de-energized, then bias heater 345 will be enabled. Otherwise, bias heater 345 will be disabled. Bias heater 345 is in thermal contact with auto damper unit 338 and enabled by CPU 352 to further open damper door 334 such that additional cooling air is sent into fresh food compartment 8.

In order to enhance the performance of the overall system 30, 30*a,* it is preferable to have damper 160 cycle open and closed under certain conditions. For instance, when power is initially supplied to refrigerator cabinet 2, it is desired to cycle damper 160 in order to establish a known initial position. Also, if a certain time period, such as 30 minutes, elapses and CPU 352 has not demanded a change in state, it is desired to cycle damper 160. If damper 160 was initially in an opened state, it will return to this state after cycling is complete. On the other hand, if damper 160 was initially in a closed state, it is desired to bypass the cycling routine. Furthermore, it is desired to cycle damper 160 after each defrost cycle. Finally, cycling of damper 160 occurs when the "off" or normal setting is selected at first button 358 for a given system 30, 30*a*. A delay of approximately 20 seconds is given within CPU 352 to permit a completion of a change of damper state. During this period of time, CPU 352 will not permit a response by damper 160 to any subsequent requests to change the damper state until the current request has been met.

If a failed sensor, e.g. temperature sensor 117, condition is detected by the CPU 352, power to fan 71 is terminated and damper 160 is driven to the closed state. The overall system 30, 30*a* will remain idle in this mode until the faulty circuit is corrected. Preferably, display 379 shall indicate an open or short circuit, such as by displaying a "F1" code. In general, a short circuit condition is defined by any resistance signal less than a certain value, such as 24 k-ohms. An open circuit condition is defined by any resistance signal greater than a certain value such as 6.1 M-ohms.

In general, it should be readily apparent that the control system of the present invention is designed to maintain the temperature within receptacle 120 in a fairly finite range based on preset limits established for the various settings through buttons 360–362. That is, CPU 352 controls an overall air flow regulating assembly including fan 71, damper 160 and bias heater 345 in a manner which provides a high performance overall system that maintains an accurate temperature within receptacle 120 by controlling the flow into food storage system 30, 30*a* and the distribution of the air about the inner housing 43. In general, it is the use of the temperature sensor 117 within the inner housing 43 which provides an accurate reading of the temperature within receptacle 120 and this sensed temperature, along with set-points established by the consumer, is used to control the air flow into and around the overall food storage system 30, 30*a*. Furthermore, the control system communicates with the controls for the overall refrigerator cabinet 2 to complement the controls for the food storage system 30, 30*a* so as to enhance the ability of the overall arrangement to maintain a relatively low temperature deviation range within receptacle 120.

FIGS. 10 and 11 illustrate an embodiment of the invention which is substantially identical to the embodiments described above and, for this reason, like reference numerals have been utilized to refer to corresponding parts which will not be reiterated here. Instead, in accordance with this embodiment, it is important to note that a frontal portion of top wall 84 is provided with one or more laterally extending inlet openings or vents, one of which is indicated at 400, which lead into food receptacle 120. In this manner, a portion of the air flowing across top wall 84 will be directed into receptacle 120, while a remainder of the air flow will continue about inner housing 43 in the manner detailed above. In the most preferred form of the invention, the air entering food receptacle 120 will initially flow downward and rearward. However, the air is forced to exit food receptacle 120 between rear wall 130 and top wall 84. Thereafter, the air is directed downward, between rear walls 88 and 130, until the air reaches one or more return openings or vents 405. This air flow path is seen to be clearly depicted by the arrowed lines in FIG. 1. As shown, exit vents 405 lead to lower plenum chamber 80 such that the air flowing through food receptacle 120 is combined with the flow of air about inner housing 43.

Based on the above, it should be readily apparent that the embodiment of FIGS. 10 and 11 differs from the prior embodiments described only with respect to the provisions for a flow of air directly through food receptacle 120. In the most preferred form of this last described embodiment, three laterally spaced inlet vents 400 are provided to allow air flow into food receptacle 120, while three additional vents 405 enable the air to exit inner housing 43. Of course, the size, shape, and number of these openings can readily vary. Instead, this embodiment advantageously enables a quick chill of food products placed in food receptacle 120 due to the direct air contact.

Figure 12:
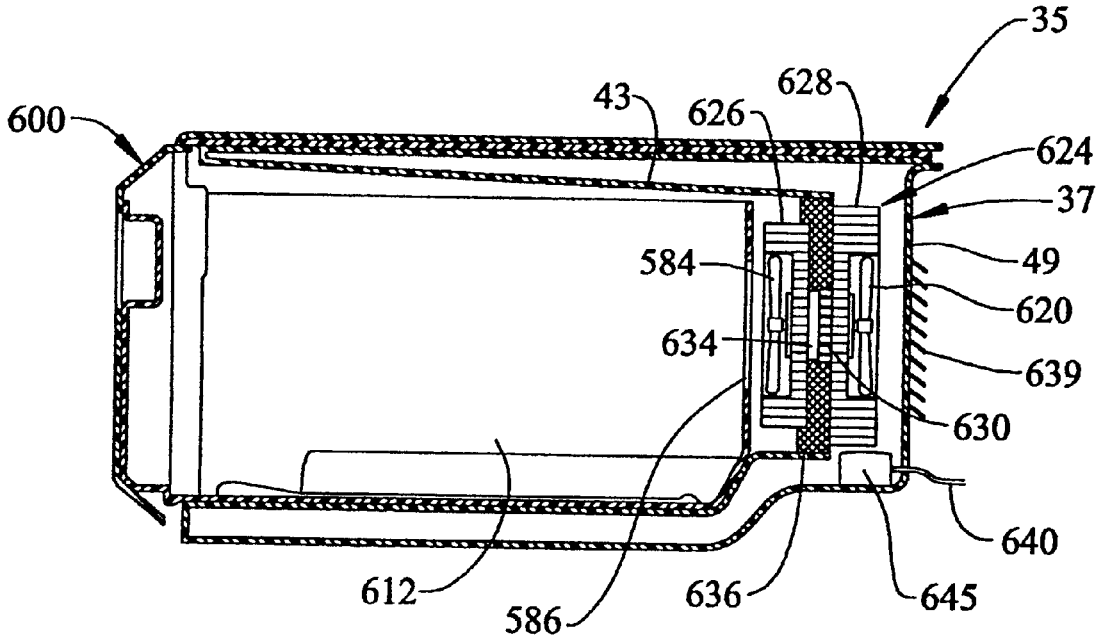
FIG. 12 is a cross-sectional side view of a thermoelectrically cooled, refrigerator temperature controlled storage compartment constructed in accordance with another embodiment of the invention.
Figure 13:
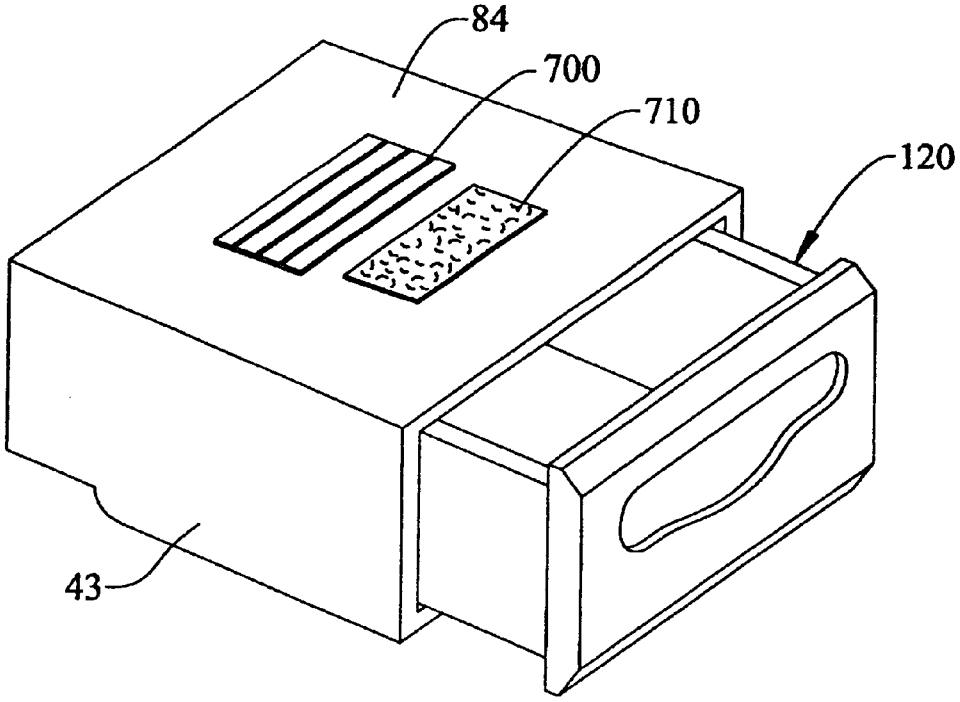
FIG. 13 is a schematic view of another thermoelectrically cooled, refrigerator temperature controlled storage compartment constructed in accordance with the present invention.

Still further embodiments of the present invention is represented in FIGS. 12 and 13. These embodiments basically differ from the prior described embodiments with respect to the manner in which the flow of cooling air is developed. More specifically, in accordance with each of the above-described embodiments, cold air from the freezer compartment is directly delivered into the various storage compartments. However, in accordance with the embodiments of FIGS. 12 and 13, a thermoelectric (TE) module is employed to develop the overall cooling effect. That is, with reference to the embodiment of FIG. 12, a first or inside fan 584 is arranged within inner housing 43, directly opposite a rear opening 586 provided in slidable food receptacle 600. Behind inside fan 584 is a second or outside fan 620. Between inside fan 584 and outside fan 620 is a heat sink 624 which assists in heat dissipation and absorption. Heat sink 624 is divided into a cold side 626 and a hot side 628 and is separated by a thermoelectric module or unit 630, a conductive block 634 and a layer of insulation 636. For cooling purposes, cold side 626 is located near inside fan 584 and hot side 628 is located near outside fan 620. If a warming function is desired, the arrangement of the cold and hot sides would simply be reversed.

During operation, air is directed into receptacle 600 through rear opening 586 and returned to heat sink 626, such as through a gap provided between receptacle 600 and the top wall of enclosure 43. Alternatively, one or more return openings (not shown) could be provided in side wall 612 (preferably at the front) or in the top wall of enclosure 43 (preferably at both the front of and behind receptacle 600). In addition, louvers 639 are arranged in rear wall 49 of outer housing 37 for expelling heated air from enclosure 35. A power line 640 is used to deliver electricity to thermoelectric module 630 through a power box 645. Although not shown, a drain can be provided within enclosure 35 behind food receptacle 600 for any fluid developed in connection with operating thermoelectric module 630, with the drain simply flowing to another drain provided in the bottom of fresh food compartment 8.

The embodiment of FIG. 13 essentially only differs from that described above in that a TE module 700 is arranged atop inner housing 43 (note that outer housing 37 is not shown for the sake of simplicity and, is not actually a necessary component of the overall enclosure). That is, TE module 700 is mounted to top wall 84 which, in turn, is preferably insulated with a thickness of about ¼ inches. In addition, an air gap of about ¼ inches exists between the walls of food receptacle 120 and inner housing 43 to further enhance the insulating qualities of the overall system. At this point, it should be realized that the actual construction and operation of thermoelectric devices are well known in the art. For example, TE module 700 employs two different thermoelectric materials (p-type and n-type) which are sandwiched in parallel between ceramic plates. When an electric current passes through the two conducting materials, a cooling effect is established. In essence, heat is pumped from a low temperature side to a high temperature side. The heat is dissipated to the ambient surrounding such that the overall device cools food items stored in receptacle 120. Such TE modules are characterized as flexible or variable temperature controlled, solid reliability and compact size (a typically sized TE chip is in the order of 1.75"×1.75"×⅛"), but with a limited cooling capacity and a low coefficient of performance (COP).

As employed in accordance with the present invention, the presented temperature control storage receptacle replaces a conventional crisper in a refrigerator wherein an average temperature in the order of 37° F. is maintained. The temperature control basically enables a controlled temperature ranging from approximately 31° F. to 45° F. for storing various food items. The actual load will, of course, be quite small since the temperature difference between the storage receptacle 120, 600 and fresh food compartment 8 is small, generally less than 6° F. TE module 700 is particularly suitable for this application due to the small load and temperature difference.

In any event, in accordance with this preferred embodiment of the invention, the heat load to food receptacle 120 is in the order of 5 Watts for a drawer size in the order of 18"×15"×8". A 12 volt power system is used to supply 5 watts, i.e., 2 watts to the TE module and 3 watts for fans of the overall TE cooling system, with the power supply being provided from the control system for the food receptacle which can be arranged in the manner described above or incorporated into temperature control housing 18. As indicated above, the invention can be employed to either cool or warm the interior of food receptacle 600. That is, the polarity of the power supply can be reversed to provide either warming to the food receptacle (if the desired temperature is higher than the temperature of the fresh food compartment) or cooling to the food receptacle (if the desired temperature is lower than the temperature of fresh food compartment).

Although described with respect to preferred embodiments of the invention, it should be readily apparent that various changes and/or modifications can be made to the storage compartment system of the present invention without departing from the spirit thereof. For instance, a SMP film 710 can be provided on a portion of enclosure 35 to prevent condensation. In any event, the invention is only intended to be limited by the scope of the following claims.

We claim:

1. In a refrigerator including a fresh food compartment, a food storage system comprising:

an enclosure mounted within the fresh food compartment, said enclosure including an open frontal portion;

a thermoelectric device, mounted to the enclosure, for developing a flow of temperature controlled air; and a food receptacle including a storage body having a front, bottom, side and rear walls, said food receptacle being slidably mounted for movement relative to the enclosure between a retracted position, wherein the storage body is arranged within the enclosure and the front wall extends across the open frontal portion of the enclosure, and an extended position, wherein the food receptacle is at least partially withdrawn from the enclosure to access the storage body, said food receptacle being adapted to receive the flow of temperature controlled air such that food items placed in the food receptacle are directly subjected to the flow of temperature controlled air entering the food receptacle.

2. The food storage system according to claim 1, wherein the enclosure includes a housing having a rear wall, said thermoelectric device being mounted to the rear wall.

3. The food storage system according to claim 2, wherein the rear wall of the food receptacle is provided with an opening, said opening being arranged opposite the thermoelectric device.

4. The food storage system according to claim 1, wherein the enclosure includes an inner housing having a top wall, said thermoelectric device being mounted to the top wall.

5. The food storage system according to claim 1, wherein the enclosure includes both inner and outer housings.

6. The food storage system according to claim 5, wherein the inner housing including a top wall, a bottom wall, side walls, a rear wall, and the open frontal portion, said outer housing extending about at least a substantial portion of the inner housing.

7. The food storage system according to claim 6, wherein the outer housing has an associated depth which is greater than a depth of the inner housing such that a rear chamber is defined within the enclosure, said thermoelectric device being disposed, at least in part, in the rear chamber.

8. The food storage system according to claim 7, wherein the thermoelectric device includes a pair of heat sinks, a thermoelectric module, a conductive block, a layer of insulation, and a pair of fans, at least one of the heat sinks being disposed in the rear chamber.

9. The food storage system according to claim 8, wherein at least one of the pair of fans is entirely located within the enclosure.

10. The food storage system according to claim 1, further comprising: a condensation prevention film provided on the enclosure and exposed to the food receptacle.

11. A method of controlling a storage temperature for food items placed in a food receptacle, including a storage body having front, bottom, side and rear walls, slidably supported relative to an enclosure between a retracted position, wherein the storage body is arranged within the enclosure and the front wall extends across an open frontal portion of the enclosure, and an extended position, wherein the food receptacle is at least partially withdrawn from the enclosure to access the storage body, within a fresh food compartment of a refrigerator comprising:

developing a flow of temperature controlled air by activating a thermoelectric device supported by the enclosure; and controlling the storage temperature for the food items by directing the flow of temperature controlled air into the food receptacle.

12. The method of claim 11, further comprising:

directing the flow of temperature controlled air into the food receptacle through an opening provided in the rear wall of the food receptacle.

13. The method of claim 12, further comprising:

developing the flow of temperature controlled air by activating a fan of the thermoelectric device located behind the rear wall of the food receptacle and within the enclosure.

14. The method of claim 11, further comprising:

directing the flow of temperature controlled air into the food receptacle through an open top portion of the food receptacle.

15. The method of claim 11, further comprising:

preventing condensation within the food receptacle through an SMP film provided on the enclosure.

16. The method of claim 11, wherein the thermoelectric device is operated such that the temperature controlled air functions to cool food items placed in the food receptacle.

17. The method of claim 11, wherein the thermoelectric device is operated such that the temperature controlled air functions to warm food items placed in the food receptacle.

* * * * *